United States Patent [19]

Scott

[11] 4,001,535

[45] Jan. 4, 1977

[54] MULTI-STATION PUSH BUTTON FOR GAS SWITCHES

[75] Inventor: Charles E. Scott, Indianapolis, Ind.

[73] Assignee: P. R. Mallory & Co. Inc., Indianapolis, Ind.

[22] Filed: Aug. 11, 1975

[21] Appl. No.: 600,241

[52] U.S. Cl. ..... 200/340; 200/159 R

[51] Int. Cl.[2] ..... H01H 13/14

[58] Field of Search .... 200/5 B, 5 D, 5 E, DIG. 25, 200/314, 340, 159 R

[56] References Cited

UNITED STATES PATENTS

| | | | |
|---|---|---|---|
| 3,047,700 | 7/1962 | Bailey | 200/340 |
| 3,161,743 | 12/1964 | Roeser | 200/314 |
| 3,663,780 | 5/1972 | Golbeck | 200/159 R |
| 3,826,884 | 7/1974 | Lewandowski | 200/159 R |
| 3,916,150 | 10/1975 | Abernathy | 200/340 |

*Primary Examiner*—Gerald P. Tolin
*Attorney, Agent, or Firm*—Hoffmann & Meyer

[57] ABSTRACT

A push button has successive adjacent stations to receive push rods of switches, the first station being disposed a predetermined distance from the button case, the next two stations being disposed at distances which are at predetermined ratios based on the location of the first station.

4 Claims, 3 Drawing Figures

MULTI-STATION PUSH BUTTON FOR GAS SWITCHES

Generally speaking the present invention relates to a push button which comprises an outer case; a compartment carried within the case having at least two opposed upstanding side walls; and means disposed along the side walls which by itself divides the compartment into successive adjacent stations for receiving switch actuators, the means being located along the walls such that a first station is disposed a predetermined distance from the case, the next two of the stations being spaced from the first station such that the ratios of the distance from the centerlines of the two stations to the case to the distance from the centerline of the first station to the case are about 1.5 and 2.0 respectively.

The invention pertains to push buttons which are particularly adaptable to gang switches having individual push rods to actuate the switch and more particularly to a push button which can be used on different gang switches.

Gang switches or multistation push button switches are commonly used in appliances such as microwave ovens wherein an operator may select various cooking times. Such gang switches are more or less standardized between manufactures. However, within limits there are differences in the switches. For example, while most of the gang units are mounted with their actuating buttons extending through a panel cutout, their push rod center distances are sometimes not the same. Under such situations, the push rods may not accept the same push button or equally bad, gaps may be left between the panel and the buttons. Therefore, separate buttons need to be made for separate units. This of course is costly and time consuming.

Accordingly it is a feature of the present invention to provide a push button which, within limits, can be used for different switches. Another feature of the invention is the provision of such a push button having stations for receiving switch actuators, the stations being spaced at different locations. Still another feature of the invention is the provision of such a push button wherein the stations are provided by a means disposed along a side wall of a compartment within which the stations are formed. Yet another feature of the invention is the provision of such a push button wherein the compartment is disposed within a case, successive stations are disposed adjacent each other within the case, and wherein a first station is located a predetermined distance from the case, the next two successive stations being located in relation to the first station.

These and other features of the invention will become apparent from the following description taken in conjunction with the accompanying drawings wherein.

Figure 1:
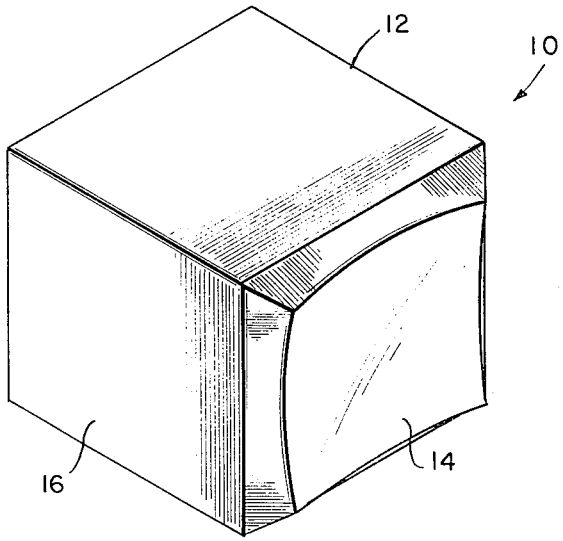
FIG. 1 is a pictorial view of a push button embodying the features of the invention.
Figure 2:
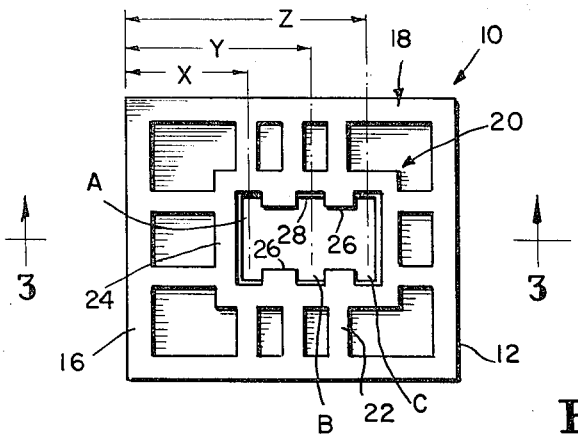
FIG. 2, is a rear view of the button.
Figure 3:
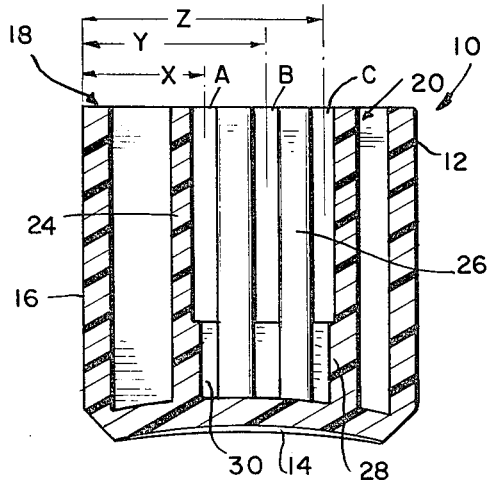
FIG. 3, is a section taken along the line 3—3 of FIG. 2.

Referring now to the drawings there is shown a push button 10 having an outer case 12 comprising a front face 14 and side walls 16. The rear portion 18 is open and, as will be hereinafter described, adapted to receive push rods of push-pull switches. The front face 14 is curved to mate an operator finger.

There is a compartment 20 carried within the outer case through a pluraltiy of studs 22. The compartment includes four upstanding side walls 24, two of the opposed walls having opposed ribs 26 dividing the compartment into successive adjacent stations. Each station is adapted to receive a push rod for a push pull switch. The walls 24 have, at the bottom portion of the compartment, a ledge 28 to provide a smaller section 30 of a station for a better fit of the push rods.

According to the invention the stations are offset from the center of the case in order to provide varying distances from a station to the case so that, within limits, the button may be used on gang switches of varying center distances between push rods. In the illustrataive embodiment station A is set at a predetermined distance from the case dependent primarily upon the distance from the end of a gang switch to the first push rod. Then further according to the invention, the next station B is positioned such that the ratio of the distance Y from the centerline of station B to the case to the distance X from the centerline of station A to the case is about 1.5. For the ratio of the distance Z from the centerline of station C to the case X is about 2.0. Such locations of the stations have been found to be useful in providing a push button adaptable to several gang switches.

There is a compartment 20 carried within the outer case through a plurality of studs 22. The compartment includes four upstanding side walls 24, two of the opposed walls having opposed ribs 26 dividing the compartment into successive adjacent stations. Each station is adapted to receive a push rod for a push pull switch. The walls 24 have, at the bottom portion of the compartment, a ledge 28 to provide a smaller section 30 of a station for a better fit of the push rods.

According to the invention the stations are offset from the center of the case in order to provide varying distances from a station to the case so that, within limits, the button may be used on gang switches of varying center distances between push rods. In the illustrative embodiment station A is set at a predetermined distance from the case dependent primarily upon the distance from the end of a gang switch to the first push rod. Then further according to the invention, the next station B is positioned such that the ratio of the distance Y from the centerline of station B to the case to the distance X from the centerline of station A to the case is about 1.5. For the ratio of the distance Z from the centerline of station C to the case to X is about 2.0. Such locations of the stations have been found to be useful in providing a push button adaptable to several gang switches.

What is claimed is:

1. A multi-station push button comprising:

a. an outer case having side walls, b. a compartment carried within said case having at least two side walls in spaced parallel relationship, c. means attached to and distinguishable from said compartment side walls which by itself divides said compartment into successive in-line adjacent stations for receiving any one of plurality of switch actuators with various center distances therebetween, said means located along said compartment side walls such that a first station is disposed a predetermined distance from one wall of said case side walls, the next two of said stations being spaced from said first station in-line such that the ratios of the distance from the centerlines of said next two in-line stations to said one wall to the distance from the centerline of said first station to said one wall are about 1.5 and 2.0 respectively.

2. A multi-station push button according to claim 1 wherein said divider means attached to said compartment side walls are ribs.

3. A multi-station push button according to claim 1 wherein said compartment is carried in said case by studs connecting said compartment to said case.

4. A multi-station push button according to claim 1 wherein said compartment side walls include ledges near the bottom portion of said compartment to provide a better fit with said switch actuators.

* * * * *

UNITED STATES PATENT AND TRADEMARK OFFICE

CERTIFICATE OF CORRECTION

PATENT NO. : 4001535

DATED : January 4, 1977

INVENTOR(S) : Charles E. Scott

It is certified that error appears in the above–identified patent and that said Letters Patent are hereby corrected as shown below:

Col. 1, line 27 delete "manufactures" and insert ---manufacturers--.

Col. 1, line 68 delete "pluraltiy" and insert ---plurality--.

Col. 2, line 13 delete "illustrataive" and insert ---illustrative--.

Col. 2, line 19 delete "X" and insert ---'X'---.

Col. 2, line 18, delete "4" and insert ---'4'---.

Col. 2, line 20 delete "Z" and insert ---'Z'---.

Col. 2, line 21 delete "case X" and insert ---case to 'X'---.

Col. 2, delete lines "25 through 50"

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*